US006089490A

United States Patent [19]

Zeuch et al.

[11] Patent Number: 6,089,490

[45] Date of Patent: Jul. 18, 2000

[54] METHOD OF AND APPARATUS FOR TRANSFERRING EXTRUDED METAL WIRE RINGS IN PROTECTIVE TUBS

[75] Inventors: Bernhard Zeuch, Ratingen; Janusz Gillner, Mülheim, both of Germany

[73] Assignee: SMS Eumuco GmbH, Leverkusen, Germany

[21] Appl. No.: 09/225,040

[22] Filed: Jan. 4, 1999

[30] Foreign Application Priority Data

Jan. 5, 1998 [EP] European Pat. Off. ..... 98100059

[51] Int. Cl.[7] ..... B65H 51/00; B21C 47/24

[52] U.S. Cl. ..... 242/364; 242/363; 242/909; 140/2; 72/135; 72/146

[58] Field of Search ..... 242/364, 363, 242/361.5, 909; 140/2; 72/135, 146

[56] References Cited

U.S. PATENT DOCUMENTS 3,176,385 4/1965 Morgan et al. ..... 242/363 X

*Primary Examiner*—John Q. Nguyen
*Attorney, Agent, or Firm*—Herbert Dubno

[57] ABSTRACT

Wire rings or coils in tubs pass from a cooling conveyor onto a rotatable framework in which the tub carrier can be raised toward a transfer conveyor. The framework is then tilted to deposit the wire ring on the transfer conveyor, whereupon the tub is raised to liberate the wire ring which is displaced onto a conveyor for a subsequent processing station. The framework is rotated again through 180° to align the empty tub with the return conveyor.

12 Claims, 4 Drawing Sheets

METHOD OF AND APPARATUS FOR TRANSFERRING EXTRUDED METAL WIRE RINGS IN PROTECTIVE TUBS

FIELD OF THE INVENTION

Our present invention relates to the cooling of wire rings and especially rings coiled from extruded metal stock. The invention also relates to an apparatus for this purpose.

BACKGROUND OF THE INVENTION

Extruded metal stock, which can be coiled into rings or coils, is hereinafter referred to as "wire" and will be understood to include extruded rod as well as structural shapes and profiles, i.e. rod or wire of any cross section including circular cross section, prismatic cross section and structural shape cross section, as well as tubular rod or stock.

For details of hot metal extrusion, reference may be had to the following works: "Strangpressanlagen mit Hilfs- und Folgeeinrichtungen für Kupferwerkstoffe"; Dieter Veltjens, Metall 29 (1975) 11, pages 1110 to 1117, "Strang-und Rohrpressanlagen für die Schwermetallindustrie"; F. J. Zilges, Metall 36 (1982) 4, pages 439 to 443, "Hauptkriterien bei der Auslegung einer Strangpressanlage für Schwermetall".

Whether the cross sections of the extruded stock are solid or hollow, to the extent that they are to be coiled in rings or coiled in coiler apparatus, they are referred to "wire" herein and it is not uncommon in the cooling of such wire to coil the wire into so-called wire rings and then transport the wire rings through the coiling line in protective tubs. Following the cooling operation, the wire rings may be subjected to further processing or treatment, for example, to a binding of the coils or wire rings, to collection of the wire rings and/or to the delivery of the wire rings for some other purpose. For such processing, the wire rings may be separated from their protective tubs and generally the protective tubs are reused.

It is, therefore, a common practice to coil the wire rings in the protective tubs, to displace the tubs containing the respective wire rings along the cooling path and at the end of the cooling path to remove the wire rings from the protective tubs, return the tubs to the coiling stations and pass the wire rings onto the stations for subsequent processing.

In the past, during the course of separation of the wire rings from their respective protective tubs, there has been a tendency for the wire rings or coils to loosen and to lose the compact form which is desirable for the coil or ring.

OBJECTS OF THE INVENTION

It is therefore the principal object of the present invention to provide an improved method of cooling extruded-metal wire in the form of wire rings in protective tubs, whereby the discharge of the wire rings from the tubs does not cause excessive loosening or permit the wire ring to lose its compact form.

Another object of the invention is to provide a method of handling extruded wire metal whereby drawbacks of earlier systems are avoided.

It is also an object of this invention to provide an improved apparatus for the processing of extruded metal wire, including the cooling thereof in the form of coils or rings and the transfer of the wire rings to subsequent processing stations in a highly advantageous.

SUMMARY OF THE INVENTION

These objects and others which will become apparent hereinafter are attained, in accordance with the present invention, in a method which enables the rings formed from extruded metal wire in respective protective tubs to be discharged from these tubs and to pass to subsequent processing stations. This method can comprise the following sequence of steps:

(a) inverting the protective pan containing a wire ring lying therein upon its removal from the main conveyor through 180°;

(b) lifting the protective pan from the wire ring which has thereby been deposited on a transfer conveyor and, laterally displacing the wire ring in the direction of the subsequent processing station; and (c) inverting the protective pan again and delivering it to a return conveyor which carries the protective tub back to the coiling station.

In more specific terms, the method can comprise the steps of:

(a) coiling hot metal wire upon extrusion thereof into wire rings and displacing the wire rings in respective protective tubs along a main conveyor of a cooling line;

(b) at a transfer station at a downstream location removing each wire ring in the respective protective tub from the main conveyor and rotating the protective tub with the respective wire ring therein through 180° to invert the tub and deposit the wire ring therein onto a transfer conveyor;

(c) lifting the inverted wire tub from the wire ring deposited upon the transfer conveyor and displacing the deposited wire ring laterally to a subsequent processor; and (d) laterally transferring the protective tub from which the wire ring has been deposited onto a return conveyor for re-use in cooling additional wire rings.

The apparatus of the present invention in its broadest terms can comprise:

means for coiling hot metal wire upon extrusion thereof into wire rings and displacing the wire rings in respective protective tubs along a main conveyor of a cooling line, thereby cooling the wire rings in the protective tubs;

transfer means at a transfer station at a downstream end of the cooling line for removing each wire ring in the respective protective tub from the main conveyor and rotating the protective tub with the respective wire ring therein through 180° to invert the tub and deposit the wire ring therein onto a transfer conveyor;

means at the transfer station for lifting the inverted wire tub from the wire ring deposited upon the transfer conveyor and displacing the deposited wire ring laterally to a subsequent processor; and means for laterally transferring the protective tub from which the wire ring has been deposited onto a return conveyor for re-use in cooling additional wire rings.

Advantageously, the main conveyor and the return conveyor have parallel horizontal longitudinal axes and the transfer means includes a framework rotatable about a horizontal rotation axis parallel to the longitudinal axes. The transfer conveyor is mounted in the framework and being parallel to the rotation axis, the means for lifting including a tub carrier mounted in the framework and displaceable toward and away from the transfer conveyor. The tub carrier has a receiving surface for a tub and a wire ring therein which is aligned with the main conveyor at a starting point of operation of the transfer means. The transfer conveyor is located at a distance above the receiving surface equal to at least a height of the protective pan, the transfer conveyor lying substantially at a level of a subsequent-processor conveyor upon inversion of the framework through 180° from the starting point. The transfer means can include means for raising the surface and a tub thereon by at least twice the height from the transfer conveyor upon inversion of the framework and clamping means for releasably securing the tubs on the surface.

By providing the rotatable or tilting transfer framework, the wire ring can be retained in its protective tub until the tub with the wire ring therein has been inverted, leaving the wire ring on the surface of the transfer conveyor and allowing the tub to be raised so that the wire ring is not disturbed but is permitted to be delivered by the transfer conveyor to the subsequent processing station while the framework reinverts the tub and allows the tub to be delivered to the return conveyor until the framework reinverts, after the wire ring has been delivered to the subsequent processing station conveyor, it rests on the surface to which it was delivered by the inverting of the tub in the first place.

BRIEF DESCRIPTION OF THE DRAWING

The above and other objects, features, and advantages will become more readily apparent from the following description, reference being made to the accompanying drawing in which.

SPECIFIC DESCRIPTION

In the following description, reference may be had to four stages A, B, C and D, keyed to FIGS. 7A–8A, FIGS. 7B, 8B, FIGS. 7C, 8C and FIGS. 7D, 8D, respectively.

Stage A is intended to be the stage in which coiled wire in its protective tube is fed from the main conveyor to the receiving surface and in which the open side of the tub is juxtaposed with the transfer conveyor in the tiltable transfer framework.

Stage B is the stage after rotation of the transfer framework through 180° with the transfer conveyor having received the wire ring or coil and before the tub has been lifted.

Stage C is the stage after lifting of the tub, leaving the coil or wire ring on the transfer conveyor so that it can be displaced laterally, i.e. in a direction transverse to the vertical direction, out of the framework and from beneath the inverted protective tub. Note that the term "transverse" is used here to refer to the displacement of the coil or ring and is used with reference to the vertical direction in which the tub is moved and the transverse direction can be parallel to the direction in which the tub and wire ring have been fed into the framework, or at a right angle thereto.

Phase D is the phase in which the framework has been reinverted through 180° to the starting position and in which the receiving surface of the tub carrier has been brought into alignment with the return conveyor so that the tub can be shifted onto the return conveyor or returned to the coiling location from the position in stage D, the tub carrier can be raised into alignment with the main conveyor (Stage A).

Figure 1:
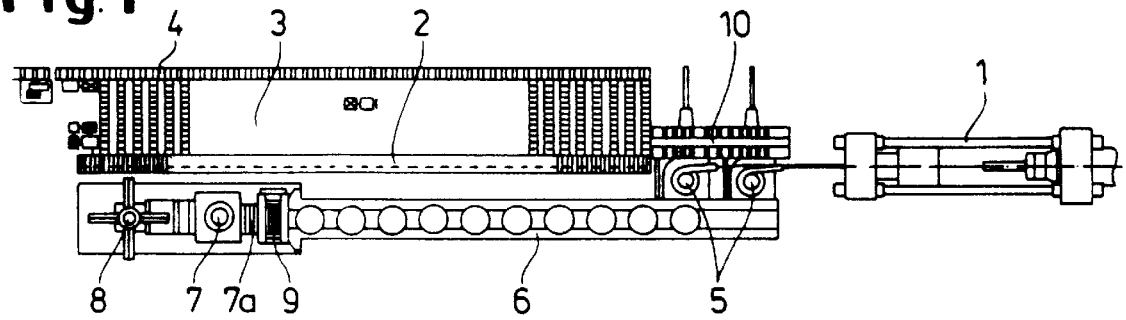
FIG. 1 is a highly diagrammatic plan view of an extrusion press and part of the apparatus of the present invention.
Figure 2:
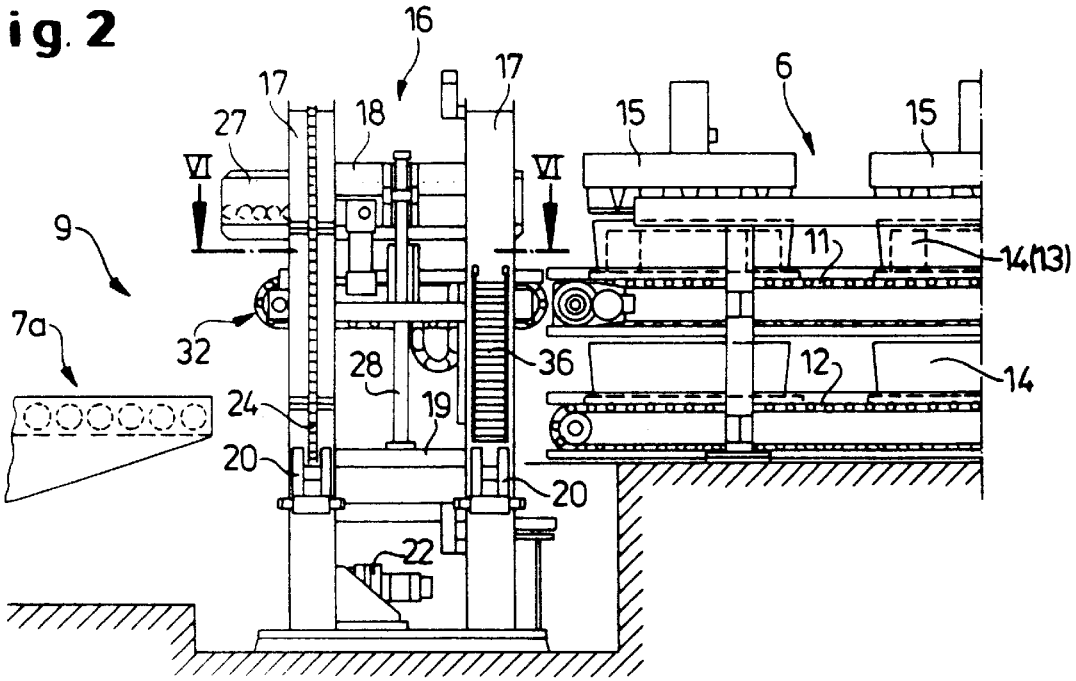
FIG. 2 is a side elevational view drawn to a significantly larger scale than FIG. 1 showing the transfer apparatus.
Figure 3:
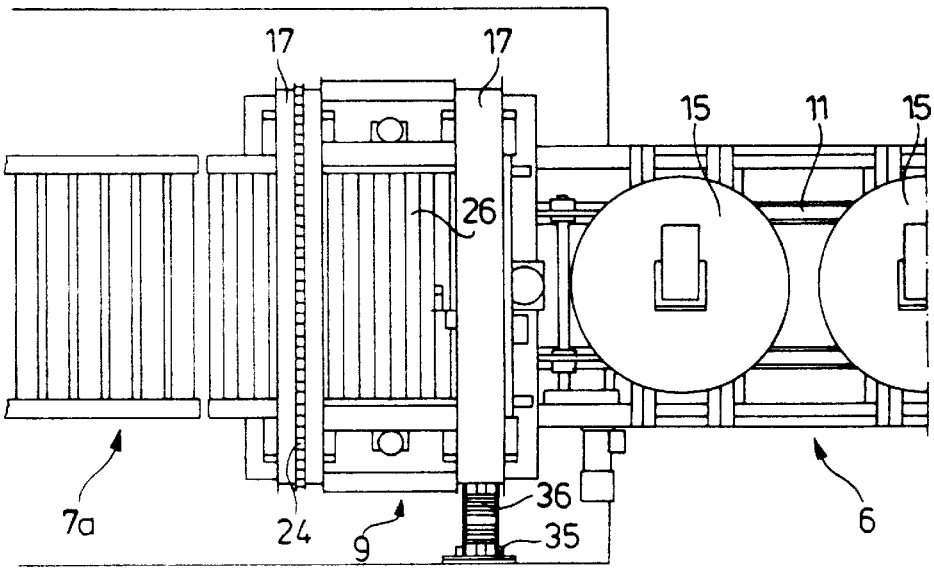
FIG. 3 is a plan view of the region shown in FIG. 2.

In FIG. 1 we have shown an extrusion press 1 for the extrusion of elongated rod-shaped metal structural shapes which may not be coilable as well as metal shapes and metal wire or rod which collectively are referred to herein as extruded metal wire. The metal profile when it is not to be coiled, can be deposited upon a run-out table or belt 2, cooled on transverse conveyor 3 and carried away from a roller conveyor 4 which can have sawtooth rollers. The metal wires can be coiled at 5 into rings if desired which can be cooled via a conveyor belt 6 along a cooling stretch. The wire rings are generally coiled in tubs as will be described so that they are cooled while being transported in such tubs and must be separated from the tubs for subsequent processing, in, for example a binding station 7 or a wire ring collector 8.

For transfer of the wire rings from the conveyor 6, as an example of the means for displacing the wire rings through the cooling line, to the conveyor 7*a,* for example, of the binding station 7, a transfer unit 9 is provided between the conveyor 6 and the conveyor 7*a,* downstream of the cooling line and upstream of the subsequent processing station 7.

When the coilers 5 are not used, they are bridged by an intermediate conveyor 10 allowing the elongated extruded strand to be passed onto the table or conveyor 2 without coiling.

For certain materials, the cooling of the wire in the form of wire rings is customary and in such cases it is also customary to coil the wire rings in the protective tubs and to enable those tubs to travel on a conveyor, like the conveyor 6, along the cooling path. At the end of the conveyor path 6, the wire rings must be removed from the protective tubs and the tubs recycled to the coiling stations while the wire rings are transferred to the subsequent processing units. The details of the transfer device 9 and its relationship to the conveyor 6 of the cooling zone and the conveyor 7*a* of the binder unit 7 can be seen in FIGS. 2–6. The conveyor system 6 is comprised of a main conveyor 11 for transporting the wire rings 13 in their respective tubs 14 and a return conveyor 12 beneath the main conveyor 11 for carrying the empty tubs 14 back to the coilers 5. Above the main conveyor 11, as required, blowers or ventilators 15 are provided to cool the wire rings 13 during the stepwise advance thereof in the tubs.

Figure 4:
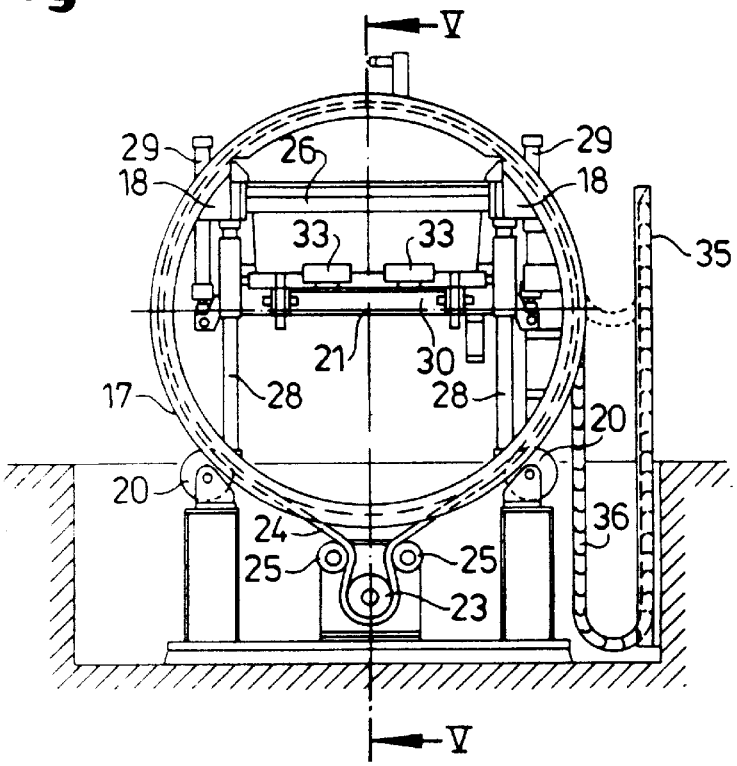
FIG. 4 is a front view of the region shown in FIGS. 2 and 3 of the apparatus of the invention.
Figure 5:
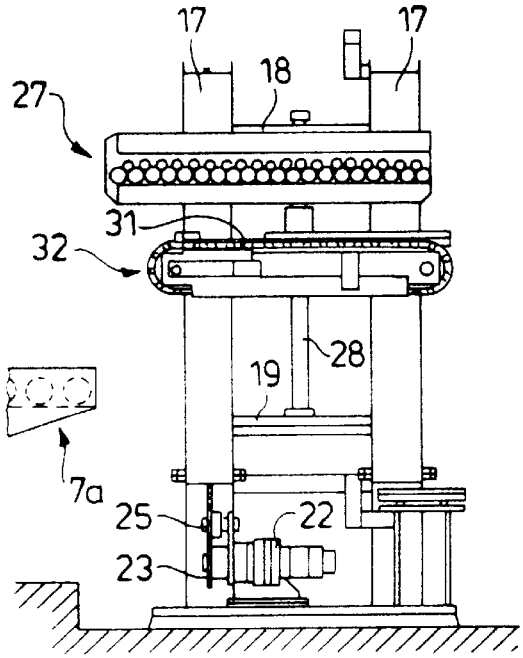
FIG. 5 is a cross sectional view taken along the line V—V of FIG. 4.

The transfer unit 9, as is especially clear from FIG. 4, comprises a tilting framework 16 composed of two vertical parallel rings 17 and horizontal struts 18 and 19 interconnecting the rings. The rings ride on rollers 20 which enable the rings to rotate about a rotation axis 21 which is parallel to the horizontal axes of the main conveyor 11 and the return conveyor 12. For tilting of the framework 16, the drive motor 22 has a sprocket wheel 23 on its shaft, the sprocket wheel enabling a chain 24 guided by idler sprockets 25 and having its opposite ends connected with one of the rings 17 of the framework.

Figure 7A:
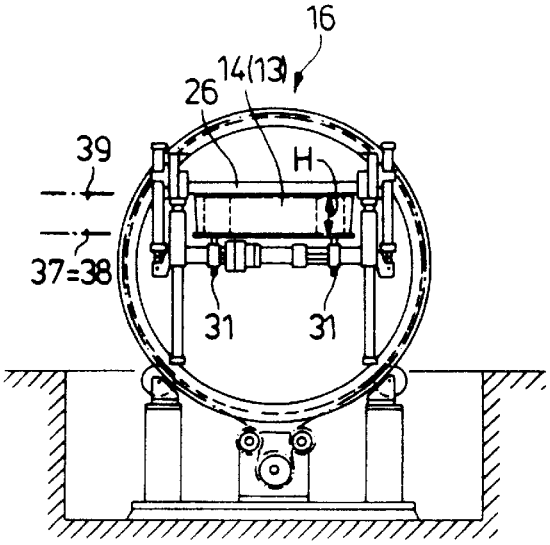
FIGS. 7A, 7B, 7C and 7D are views similar to FIG. 4 at different phases of the operation.
Figure 7B:
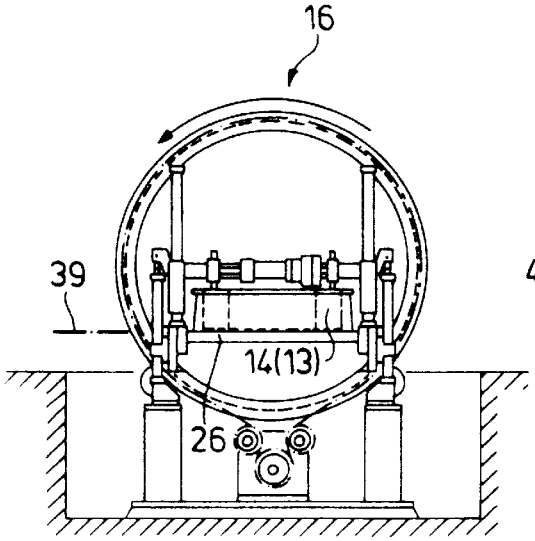
Figure 7C:
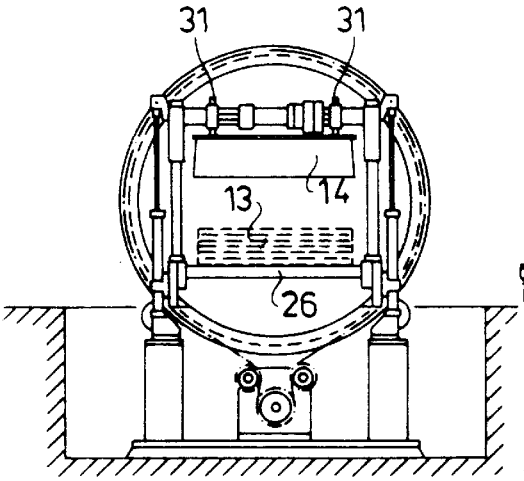
Figure 8C:
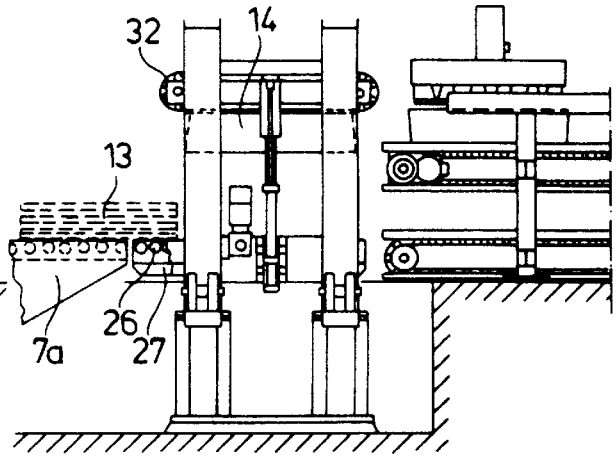

The struts 18 form bearing and drive housings for rollers 26 forming a ring transfer conveyor 27 by means of which the wire rings 13 are transferred to the conveyor 7*a* (see FIGS. 7C and 8C).

Between the struts 18 and 19 are guide bars 28 for a tub carrier or table 30 which can be shifted toward and away from the conveyor 27 by the fluid-operated piston-and-cylinder units 29. The table 30 is provided with conveyor chains 31 and has stops 33 (FIG. 6) against which the rings 13 can abut, and clamps or jaws 34 which can engage the tubs 14 from opposite sides.

Electrical and fluid supply lines and pipes can pass through the energy supply chain 36 to the conveyor 27, the tub carrier 32 and any other elements requiring power. The chain 36 is connected to one of the rings 17 and to a stand 35 with respect to which the rings 17 are rotatable.

Figure 6:
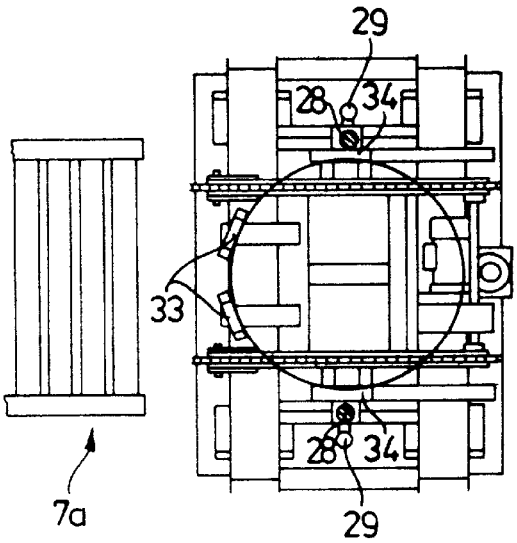
FIG. 6 is a section taken along the line VI—VI of FIG. 2.
Figure 8A:
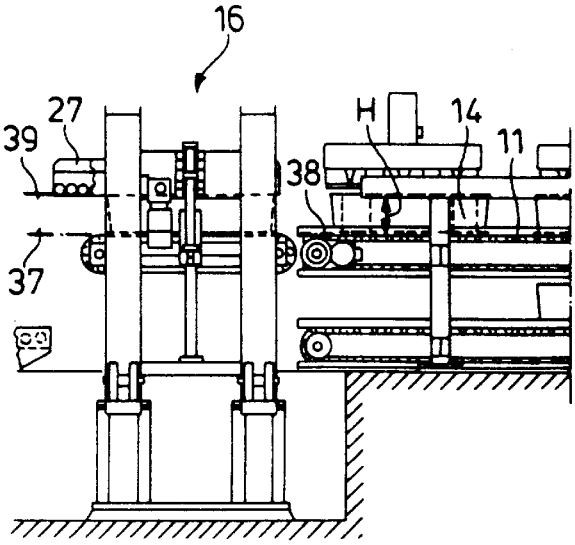
FIGS. 8A, 8B, 8C and 8D are side elevational view similar to FIG. 2 showing the corresponding phases of FIGS. 7A–7D.
Figure 8B:
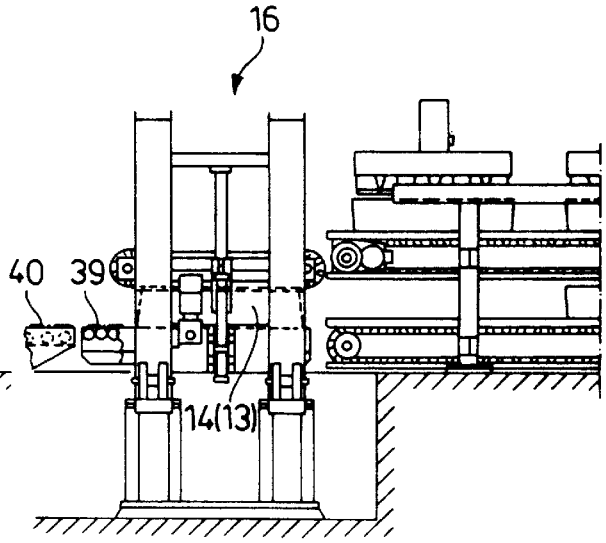

In the starting position (FIGS. 7A and 8A) the framework 16 has its tub carrier 32 with its effective surface 27 at the same level as the effective surface 38 of the main conveyor 11 so that the tub 14 can pass onto the surface 37 with a minimum of disruption. The downwardly turned effective surface 39 of the conveyor 27 is spaced above the surface 37 by a spacing H equal to the height of the tub 14 plus a minimum amount required for the play to permit travel of the tub. The tub 14 enters the space between the surfaces 37 and 39 until it engages the stops 33 (FIG. 6). The tub is then engaged by the clamp 34 so that the tub is held against the table 30. The table 30 and member 32 are then raised by the amount of the aforementioned play until the tub abuts the conveyor 27. The framework 16 is then tilted by 180° into the position shown in FIG. 7B and 8B. The ring conveyor 27 then has its effective surface 39 at the same level as the effective surface 40 of a conveyor 7*a*. The tub is then raised (FIGS. 7C, 8C) and the wire ring or coil 13, thus liberated, is delivered to the conveyor 7*a* of the binder station 7.

Figure 7D:
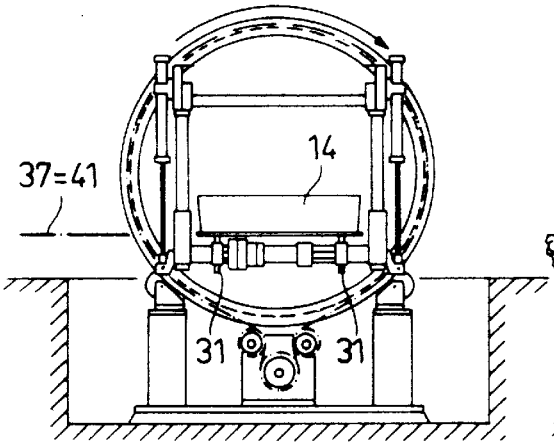
Figure 8D:
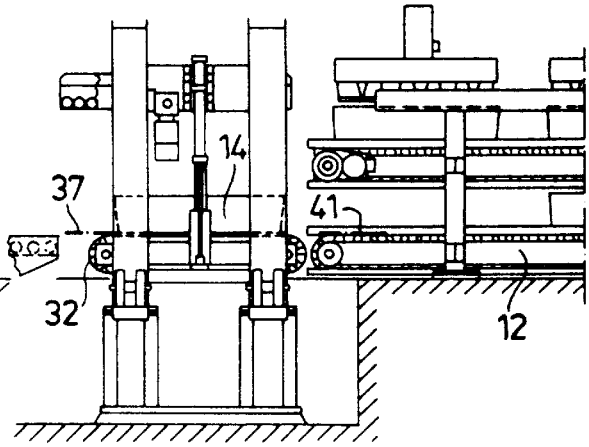

As soon as the coil 13 has been transferred from the conveyor 27, the framework 16 is tilted back through 180° to the position shown in FIGS. 7D and 8D in which the tub conveyor 32 has its effective surface 37 at the same level as the effective surface 41 of the return conveyor. The jaws of the clamp 34 are opened and the tub is delivered to the return conveyor 12 by the chains 31. The carrier 32 is raised until its effective surface 37 is again at the level of the surface 38 (the position shown in FIGS. 7A and 8A) and the next tub 14 can be accommodated. The empty tub 14, placed on the conveyor 12, can return to the coiling station 5.

We claim:

1. A method of cooling extruded metal wire, comprising the steps of:

(a) coiling hot metal wire upon extrusion thereof into wire rings and displacing the wire rings in respective protective tubs along a main conveyor of a cooling line;

(b) at a transfer station at a downstream location removing each wire ring in the respective protective tub from said main conveyor and rotating the protective tub with the respective wire ring therein through 180° to invert the tub and deposit the wire ring therein onto a transfer conveyor;

(c) lifting the inverted wire tub from the wire ring deposited upon said transfer conveyor and displacing the deposited wire ring laterally to a subsequent processor; and (d) laterally transferring the protective tub from which the wire ring has been deposited onto a return conveyor for re-use in cooling additional wire rings.

2. The method defined in claim 1 wherein said inverted wire tub is re-inverted through 180° before being deposited on said return conveyor.

3. The method defined in claim 2 wherein the subsequent processing includes a binding of the wire rings.

4. The method defined in claim 2 wherein said subsequent processing includes collecting the cooled wire rings.

5. An apparatus for cooling extruded metal wire, comprising:

means for coiling hot metal wire upon extrusion thereof into wire rings and displacing the wire rings in respective protective tubs along a main conveyor of a cooling line, thereby cooling the wire rings in the protective tubs;

transfer means at a transfer station at a downstream end of said cooling line for removing each wire ring in the respective protective tub from said main conveyor by rotating the protective tub with the respective wire ring therein through 180° to invert the tub and deposit the wire ring therein onto a transfer conveyor;

means at the transfer station for lifting the inverted wire tub from the wire ring deposited upon said transfer conveyor and displacing the deposited wire ring laterally to a subsequent processor; and means for laterally transferring the protective tub from which the wire ring has been deposited onto a return conveyor for re-use in cooling additional wire rings.

6. The apparatus defined in claim 5 wherein said main conveyor and said return conveyor have parallel horizontal longitudinal axes and said transfer means includes a framework rotatable about a horizontal rotation axis parallel to said longitudinal axes, said transfer conveyor being mounted in said framework and being parallel to said rotation axis, said means for lifting including a tub carrier mounted in said framework and displaceable toward and away from said transfer conveyor, said tub carrier having a receiving surface for a tub and a wire ring therein which is aligned with the main conveyor at a starting point of operation of the transfer means, said transfer conveyor being located at a distance above the receiving surface equal to at least a height of the protective tub, said transfer conveyor lying substantially at a level of a subsequent-processor conveyor upon inversion of said framework through 180° from said starting point; said transfer means including means for raising said surface and a tub thereon by at least twice said height from said transfer conveyor upon inversion of said framework and clamping means for releasably securing said tubs on said surface.

7. The apparatus defined in claim 6 wherein said framework comprises a pair of spaced apart parallel vertical rings centered on said rotation axis and interconnected by struts, said rings being rotatably supported on rollers, one of said rings being driven by a chain engaging said one of said rings.

8. The apparatus defined in claim 6 wherein said means for raising said surface includes fluid-operated cylinder means connected to said tub carrier.

9. The apparatus defined in claim 6 wherein said return conveyor is located below said main conveyor.

10. The apparatus defined in claim 6 wherein said subsequent processor is a binder for said wire rings.

11. The apparatus defined in claim 6 wherein said subsequent processor includes a collector for said wire rings.

12. The apparatus defined in claim 6 wherein said transfer conveyor is a belt conveyor.

* * * * *